US005709638A

United States Patent [19]

Mackert et al.

[11] Patent Number: 5,709,638

[45] Date of Patent: Jan. 20, 1998

[54] WRIST JOINT WITH ROTATION FOR AN EXERCISE DEVICE

[75] Inventors: Ross A. Mackert, St. Louis Park; John E. Titus, Prior Lake, both of Minn.

[73] Assignee: Fitness Master, Inc., Waconia, Minn.

[21] Appl. No.: 560,383

[22] Filed: Nov. 17, 1995

[51] Int. Cl.[6] ..... A63B 21/02

[52] U.S. Cl. ..... 482/130; 482/44

[58] Field of Search ..... 482/44, 45, 46, 482/129, 130, 121, 123

[56] References Cited

U.S. PATENT DOCUMENTS 5,087,031 2/1992 Hoff ..... 482/46

*Primary Examiner*—Lynne A. Reichard
*Attorney, Agent, or Firm*—Dorsey & Whitney LLP

[57] ABSTRACT

A strength training exercise apparatus includes a frame having a generally upright back rest portion, and a generally horizontal seat portion, and further includes opposing arm members pivotally mounted to the back rest portion of the frame. The arm members are movable through an arcuate range of motion, and include locking pins for selectively locking the arm members in desired angular positions. The apparatus still further includes a resistance assembly consisting of a fixed anchor mounted on the frame, a movable anchor which is movable relative to the fixed anchor, and a plurality of elastomeric resistance cords releasably secured between the movable relative to the fixed anchor to provide resistance to movement of the movable anchor. A pull line is mounted on guide pulleys along the length of the arm members, and is further received in association with the movable anchor whereby outward movement of the pull line with respect to the arm members causes movement of the movable anchor with respect to the fixe anchor. The exercise apparatus further consists of a leg member pivotally mounted to the seat portion, and a second resistance assembly including a second movable anchor coupled to the leg member, and a second plurality of elastomeric resistance cords secured between the fixed anchor and the second movable anchor for providing resistance to pivotal movement of the leg member. The leg member is movable to a storage position beneath the seat portion, and the seat and back rest portions are pivotally foldable to a generally parallel position for storage.

4 Claims, 10 Drawing Sheets

24
34
50
84
16
82
10
14
80
68
72
38
78
46
26
30
42
44
110
48
40
36
126
62
70
58
18
12
116
28
128
130
62
136
132
22
122
134
124

10
70
72
102
34
14
16
74
76
82
50
52
84
78
54
56
80
14
16
28
68
30
90
100
60
92
48
128
126
62
62
12
20
36
38
124
122
58
66
32

WRIST JOINT WITH ROTATION FOR AN EXERCISE DEVICE

The present application is a continuation-in-part of U.S. patent application entitled STRENGTH TRAINING EXERCISE APPARATUS WITH ELASTOMERIC RESISTANCE MEMBERS.

SUMMARY AND BACKGROUND OF THE INVENTION

The instant invention relates to exercise apparatus, and more particularly to a strength training exercise apparatus including elastomeric cord members which provide variable resistance to movement of various components of the apparatus.

Exercise devices which incorporate elastomeric elements or spring cables for providing resistance to movement have heretofore been known in the art. In this regard, the U.S. Patents to Wilkinson No. 418,257; Pauls et al. No. 5,090,694; Wang et al. No. 5,362,296; Sterling No. 4,921,247; Farran et al. No. 4,913,423; Wilkinson No. 5,234,394; Nathaniel No. 5,013,035; and Hermanson No. 4,848,741 represent the closest prior art to the subject invention of which the applicant is aware. While the cited prior art devices are effective for their intended purpose, there is always a continuing need for new and improved exercise devices.

The instant invention provides a strength training exercise apparatus comprising a frame having a generally upright back rest portion, and a generally horizontal seat portion, and further comprising opposing arm members pivotally mounted to the back rest portion of the frame. The arm members are pivotally movable between a plurality of angular positions to provide a multitude of different exercise positions, and include locking pins for selectively locking the arm members in the desire angular positions. The apparatus further comprises a first resistance assembly comprising a fixed anchor mounted on the frame, a movable anchor which is movable relative to the fixed anchor, and a plurality of elastomeric resistance cords releasably securable between the movable anchor and the fixed anchor. A pull line is mounted on guide pulleys along the arm members and is further received in association with the movable anchor whereby outward movement of the movable anchor with respect to the fixed anchor. Handle members are provided at the terminal ends of the pull line on each of the arm members for creating an outward movement of the pull line. The handle members are coupled to the arm members at a wrist joint for providing limited rotation. In use, movement of the handles relative to the arm members causes relative movement of the movable anchor with respect to the fixed anchor, whereby the elastomeric cords provide resistance to the movement. One or more of the elastomeric cords may be utilized to provide different resistance levels during training thereby providing a highly versatile exercise apparatus.

The strength training apparatus still further comprises a single leg member pivotally mounted to the seat portion, and a second resistance assembly for providing independent resistance to movement of the leg member. The second resistance assembly comprises a second movable anchor coupled to the leg member by an inelastic member, and a second plurality of elastomeric resistance cords secured between the fixed anchor and the second movable anchor. In use, the operator engages his/her legs with the leg member in a manner appropriate for the desired exercise, wherein movement of the leg member during extension is resisted by the elastomeric cords. As with the arms members, one or more of the elastomeric cords can be utilized to provide different resistance levels.

For storage and portability, the leg member is movable to a storage position beneath the seat portion, and the seat and back rest portions are foldable to a generally parallel, overlying position.

Accordingly, among the objects of the instant invention are the provision of a highly versatile exercise device capable of performing many different exercises; the provision of an exercise device including adjustable arm members for exercising various body muscle groups; the provision of an exercise device including a leg extension member for exercising the leg muscle groups; the provision of an exercise device including a plurality of releasably mountable elastomeric resistance members for providing different resistance levels for various exercises offered; the provision of an exercise device which is compact, easy to use, and foldable for storage within the home; and the provision of an exercise device which is of high quality, yet nevertheless inexpensive to manufacture, and market.

It is another object of the present invention to provide an exercise apparatus wherein the arm members include a wrist joint at their distal end, wherein the wrist joint provides for rotation of the handle members at the distal ends of the arm, the rotation being controlled or limited.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
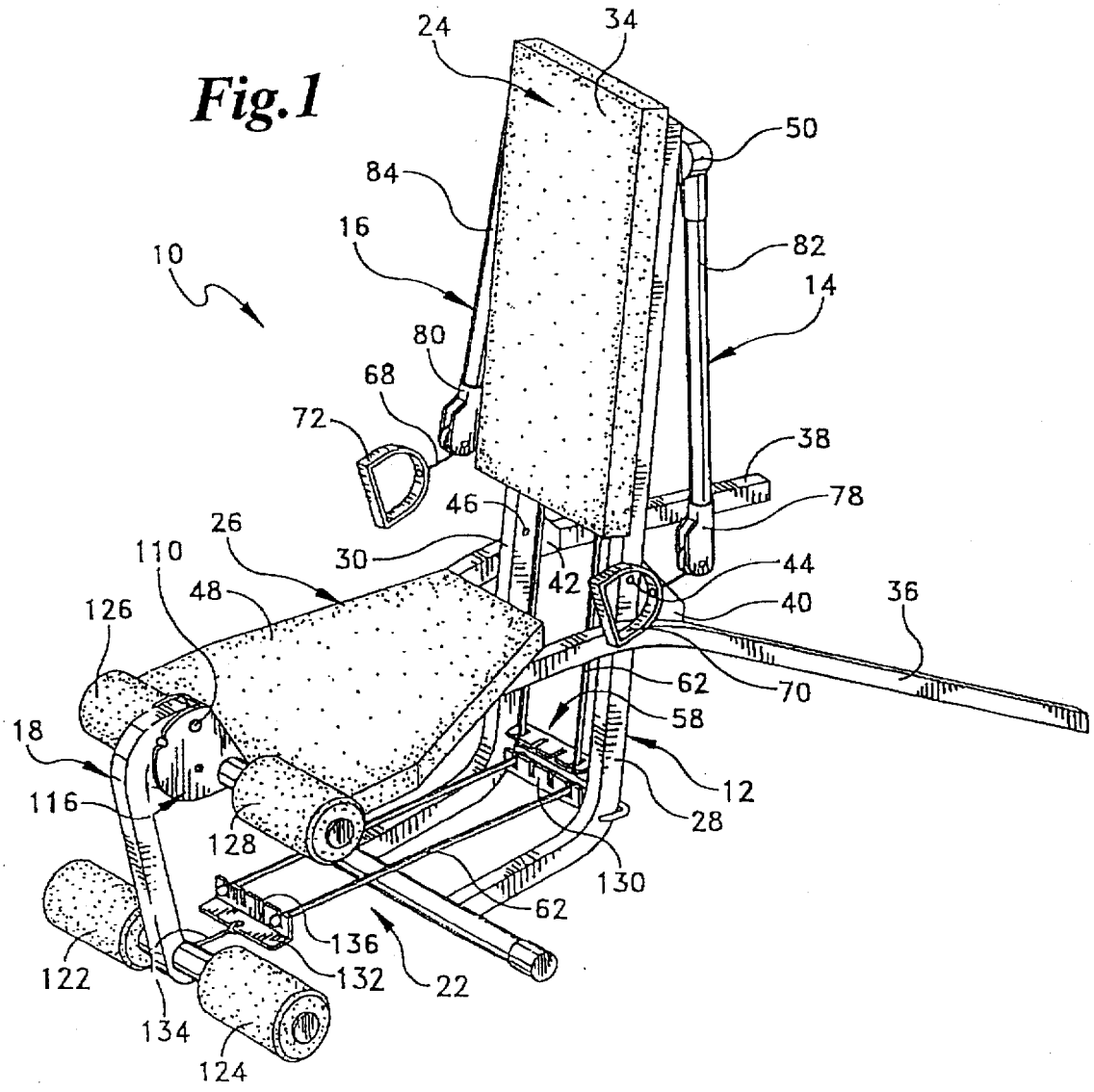
FIG. 1 is a perspective view of the strength training exercise apparatus of the instant invention.

Referring now to the drawings, the strength exercise apparatus of the instant invention is illustrated and generally indicated at 10 in FIGS. 1–8. As will hereinafter be more fully described, the instant strength training exercise apparatus 10 includes a plurality of elastomeric cords which provide variable resistance to movable leg and arm members.

The exercise apparatus 10 comprises a frame generally indicated at 12, first and second arm members generally indicated at 14, and 16 respectively, a leg member generally indicated at 18, and first and second independent resistance assemblies 20, and 22 respectively, for providing resistance to movement of the arm and leg members.

Figure 9:
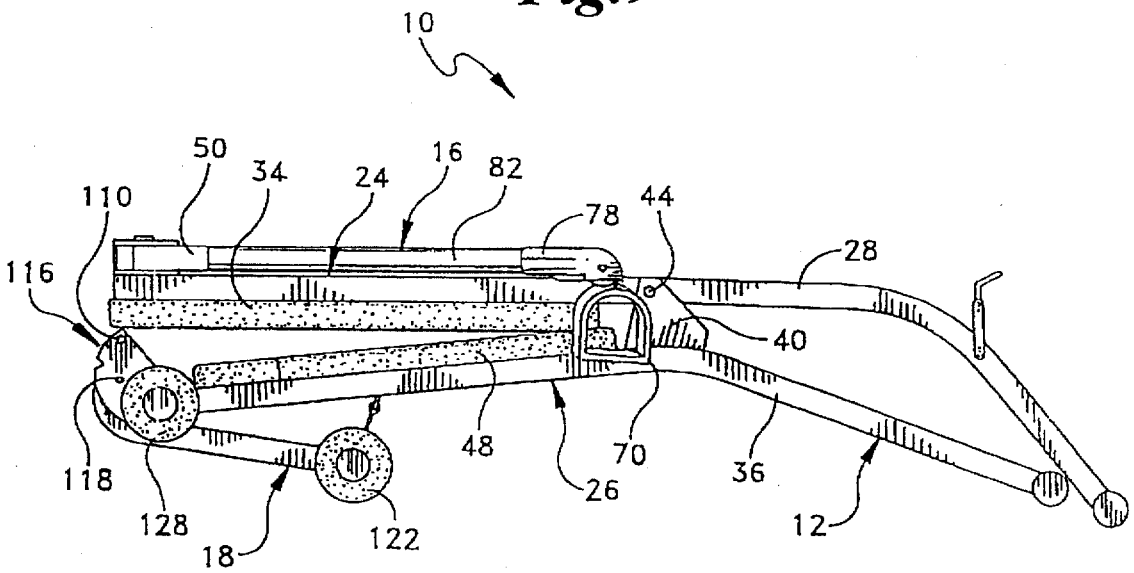
FIG. 9 is another side view of the exercise apparatus with the leg member, and the seat and back rest portions folded to their respective storage positions.
Figure 10:
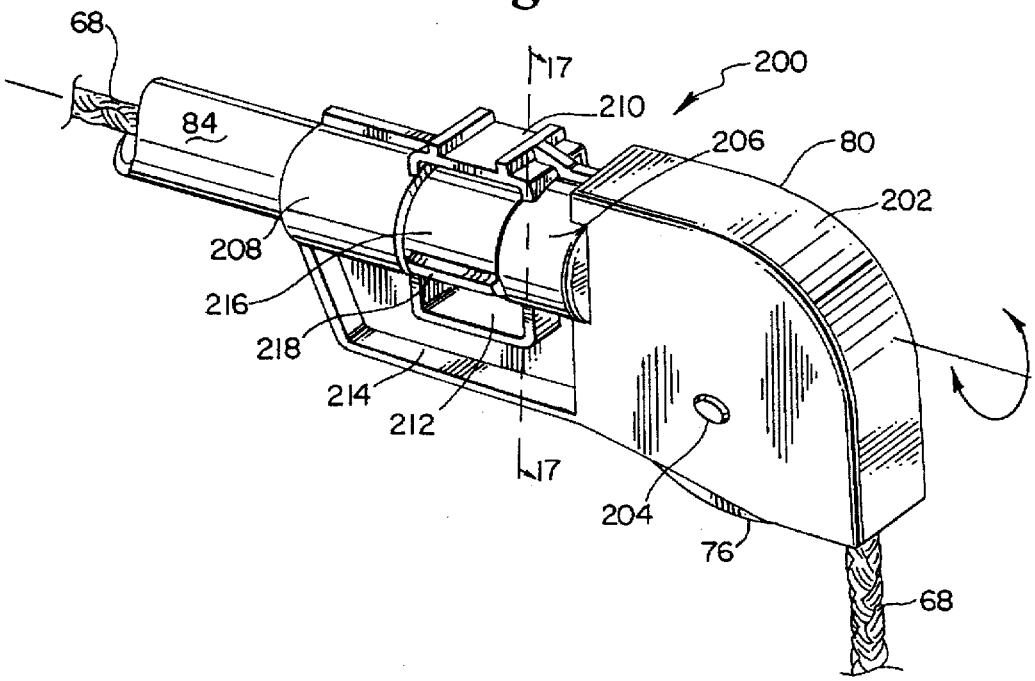
FIG. 10 is a fragmentary perspective depicted one of the two substantially identical wrist joints of the present invention.
Figure 11:
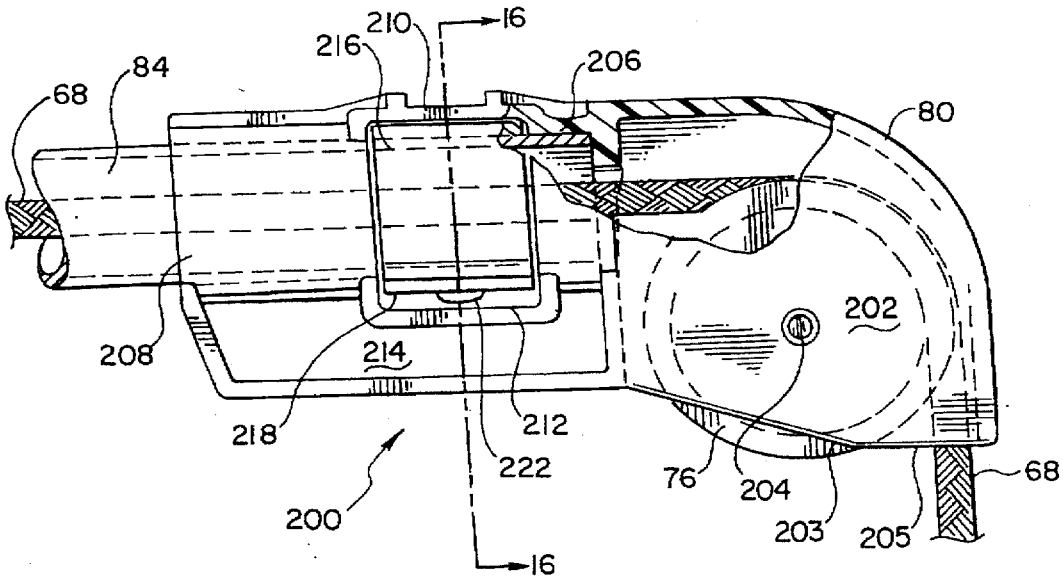
FIG. 11 is an elevational view, partially in section of the wrist joint.
Figure 12:
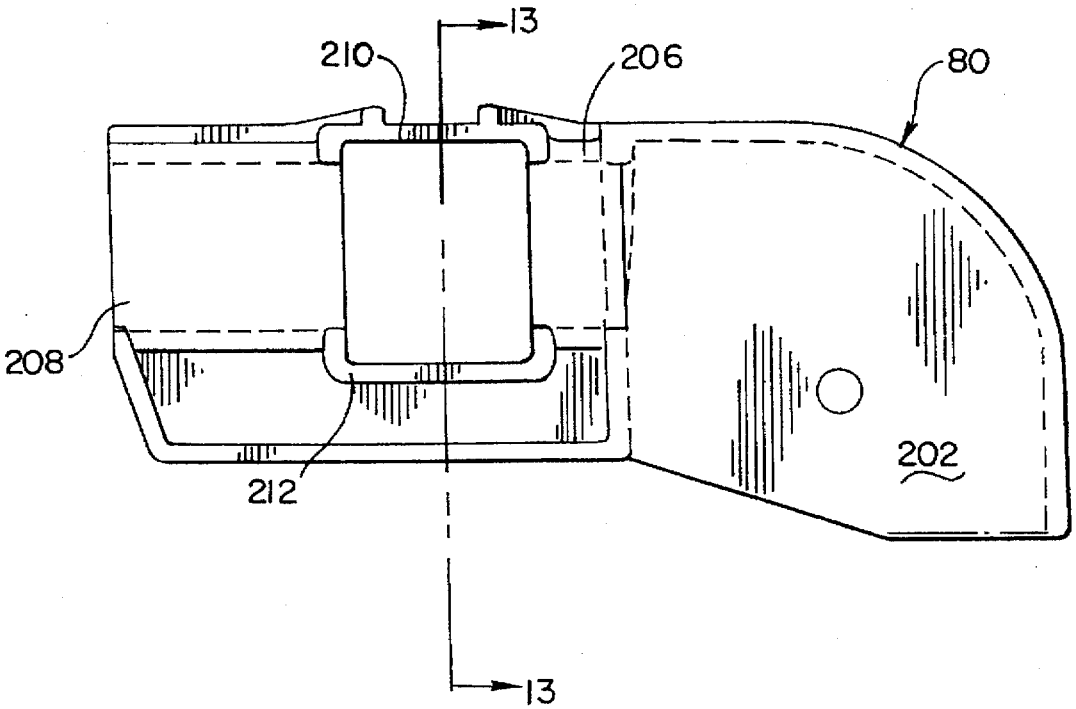
FIG. 12 depicts the end portion of the wrist joint unmounted.
Figure 13:
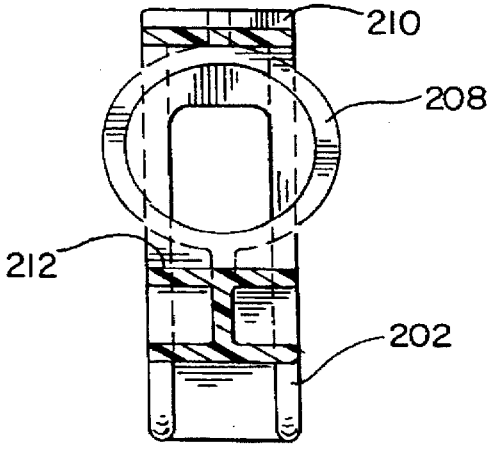
FIG. 13 is an end elevational view of the unmounted end portion.
Figure 14:
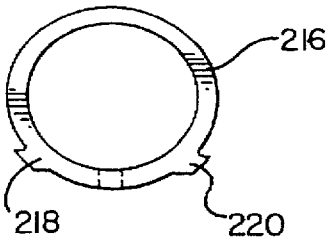
FIGS. 14 and 15 depict the stop collar for the wrist joint.
Figure 15:
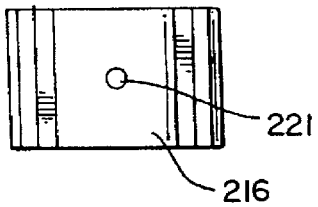

The frame 12 includes an upright back rest portion generally indicated at 24 and a seat portion generally indicated at 26. The back rest portion 24 comprises two spaced L-spaced legs 28, 30 respectively, and a cross member 32 affixed at the lower ends of the legs 28, 30. The cross member 32 engages the supporting surface (FIG. 2) for supporting the back rest portion 24. The back rest portion 34 further includes a padded panel 34 affixed to the upper portions of the legs 28, 30 for cushioning the back of an operator seated on the seat portion 26. The seat portion 26 comprises two spaced rails 36, 38 respectively, which are pivotally mounted to the legs 28, 30 of the back rest portion 24. More specifically, each of the rails 36, 38 includes a respective mounting plate 40, 42 which is pivotally affixed to the respective leg 28, 30 with a pin 44, 46. Alternatively, a single plate/pin arrangement may be used. A padded panel 48 is affixed to the forward ends of the rails 36, 38 to provide a seating surface for the operator. The rear ends of the rails 36, 38 angle downwardly, and outwardly and engage the supporting surface. In use, the seat portion 26 and back rest portion 24 are pivotally movable between an open position (FIGS. 1 and 7) wherein the seat portion 26 and back rest portion 24 are disposed at an angle of about 120 degrees, and a closed position (FIG. 9) wherein the seat portion 26 and the back rest portion 24 are generally parallel in overlying relation, i.e., the padded panel 34 of the back rest portion 24 pivots downwardly to rest on top of the padded panel 48 of the seat portion 26. The various structural members of the frame 12 are preferably constructed of a tubular steel to provide strength and durability, and are preferably welded, where necessary, to provide necessary fixed joints therebetween. The padded panels 34, 48 are of conventional construction and will not be described further.

Figure 2:
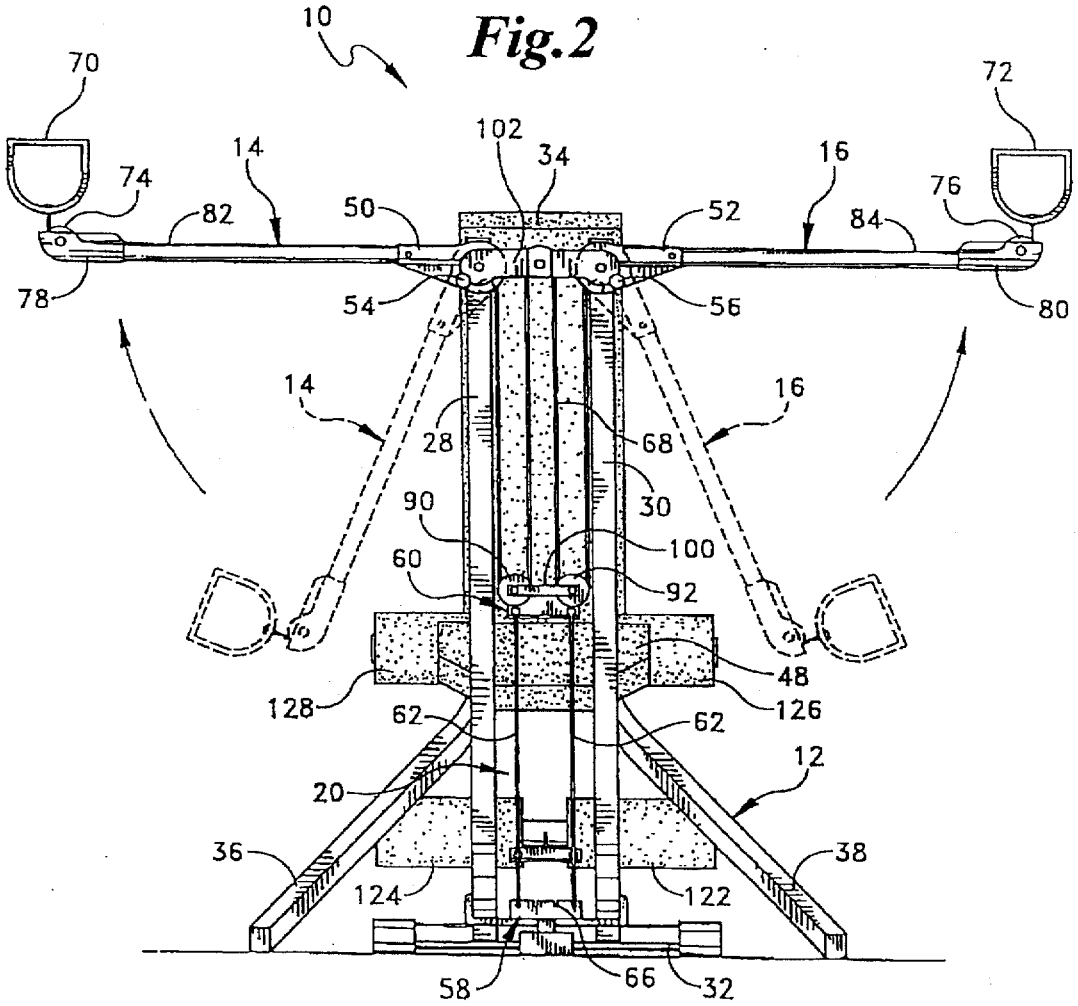
FIG. 2 is a rear view of the exercise apparatus showing pivoting movement of the arm members.
Figure 3:
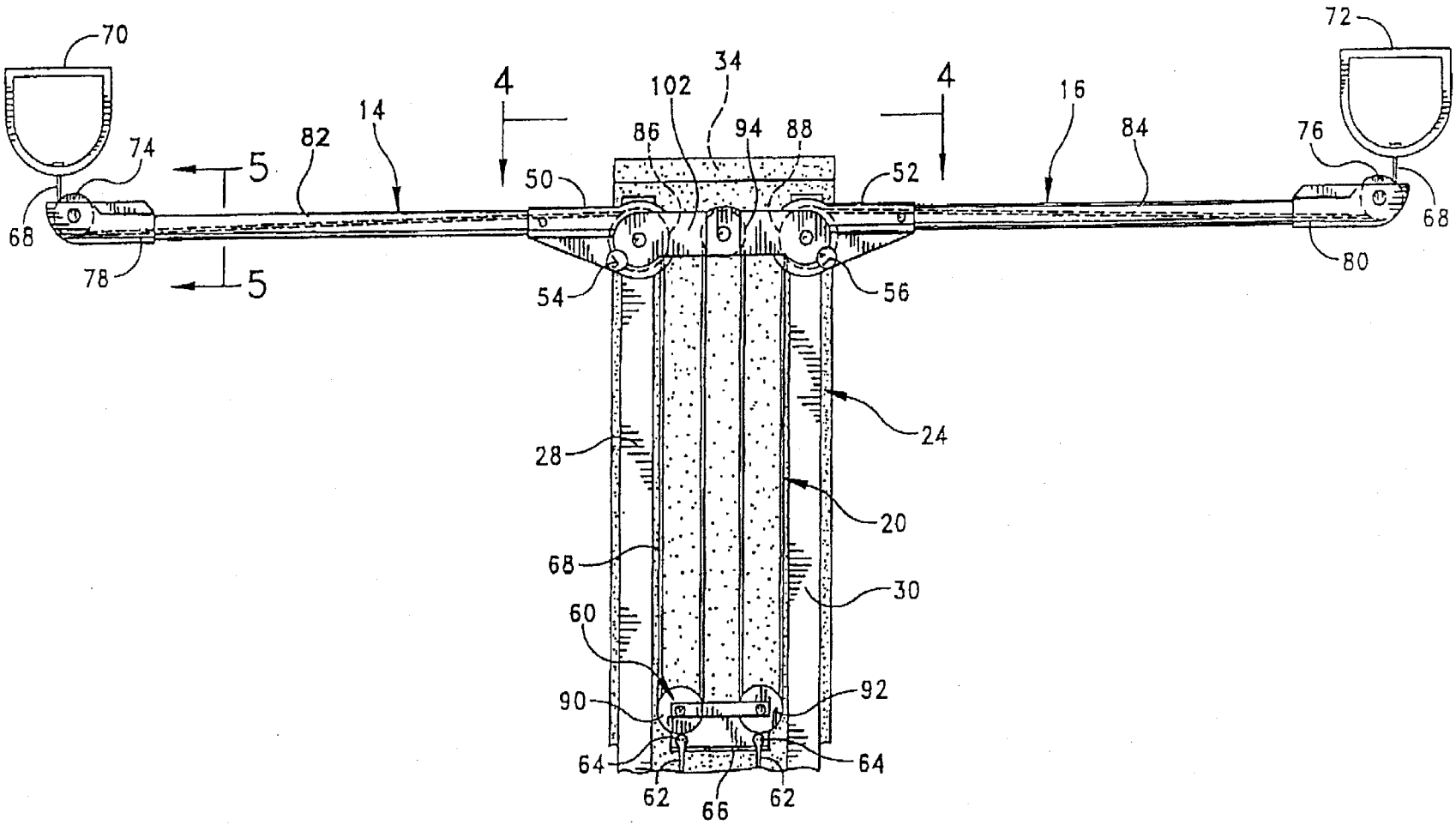
FIG. 3 is an enlarged rear view thereof showing the specific arrangement of the pull line and pulleys.
Figure 4:
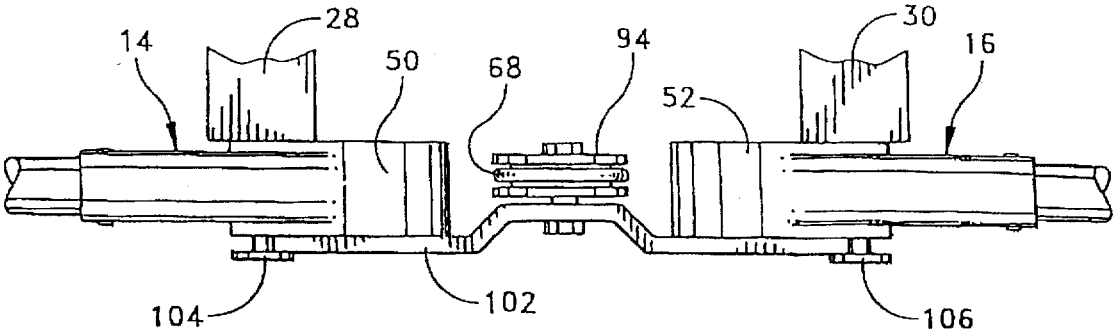
FIG. 4 is a cross-sectional view of the exercise apparatus taken along line 4—4 of FIG. 3.

The first and second arm members 14, 16 are pivotally mounted to the back rest portion 24 of the frame 12 such that they extend laterally outwardly from the back rest portion 24, and are pivotally movable through an arcuate range of motion. More specifically, respective first end portions 50, 52 of the arm members 14, 16 are pivotally mounted to an upper end section of the respective legs 28, 30 of the back rest portion 24, and they are movable in an arcuate range of motion between at least a first position (see broken lines FIG. 2), and a second position (see solid lines FIG. 2) wherein the arms 14, 16 are generally collinear. It is pointed out that the furthest downward position of the arm members 14, 16, as indicated in broken lines in FIG. 2, is still somewhat angles out to the sides, and that the arms 14, 16 do not fold behind the back rest position 24 of the frame 12. Each of the arm members 14, 16 is provided with a spring-loaded pop-type locking pin 54, 56 on the respective first end portion 50, 52 for selectively locking the arm members 14, 16 in desired angular positions within the range of motion indicated. In this regard, the pop pins 54, 56 are received into corresponding apertures in locking plates (not shown) affixed to the legs 28, 30 of the back rest portion 24 of the frame 12. Accordingly, in use, the arm members 14, 16 can be selectively positioned in one of a plurality of different angular positions by extending the pop-pins 54, 56 through one of the apertures in the associated locking plate (not shown).

The first resistance assembly 20 comprises a fixed anchor generally indicated at 58 secured to the frame 12, a movable anchor generally indicated at 60 movable relative to the fixed anchor 58, and a plurality of extendable resistance members generally indicated at 62 secured between the fixed anchor 58 and the movable anchor 60. The extendable resistance members 62 preferably comprises an elastomeric cord, such an elastomeric rubber cord which will deform under tension, and then contract, when released, to retain its original shape. The elastomeric cords 62 are preferably releasably mounted to the respective anchors 58, 60, and in this regard, the opposing ends of the elastomeric cords 62 each include an enlarged bulb 64 which is slidably received in engagement with an edge slot 66 formed in the respective anchor 58, 60. It is pointed out that each of the anchors 58, 60 includes four (4) slots 66 for the mounting of up to four elastomeric cords 62 during use. The use of one or more of the elastomeric cords 62 provides for four different levels of resistance. Although four slots have been disclosed, it is to be understood that more or fewer than four slots may be employed.

Figure 6:
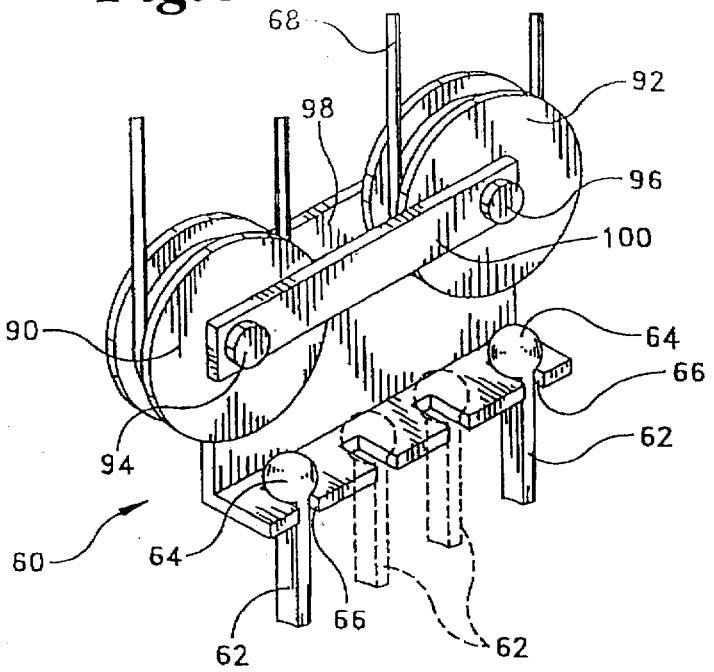
FIG. 6 is an enlarged, fragmentary perspective view of the movable anchor showing attachment of the elastomeric cords to the anchor.

Referring to FIG. 2, a single, preferably inelastic, pull line 68 is mounted on a plurality of guide pulleys along the length of the arm members 14, 16, and is further received in association with pulleys on the movable anchor 60, whereby outward movement of the pull line 68 with respect to the arm members 14, 16 causes movement of the movable anchor 60 relative to the fixed anchor 58. Respective handle members 70, 72 are provided at the terminal ends of the pull line 68 whereby the operator can grasp the respective handle 70, 72 for creating outward movement of the pull line 68. The respective ends of the pull line 68 pass over first pulleys 74, 76 mounted on pivotable end portions 78, 80 of the respective arm members 14, 16. The pull line 68 travels through respective center portions 82, 84 of the arm members 14, 16 and passes over pulleys 86, 88 (broken lines) respectively mounted at the pivot point of the respective arm member 14, 16. The pull line 68 then runs downwardly and around the two respective pulleys 90, 92 on the movable anchor 60, and upwardly in the center around a central pulley 94 to complete the loop. It can thus be appreciated that outward movement of the handles 70, 72 with respect to the arm members 14, 16, either simultaneously or independently, will cause upward movement of the movable anchor 60 away from the fixed anchor 58. Each of the pulleys is conventional in the art, and is mounted for rotation about a central axis. The two pulleys 90, 92 on the movable anchor 60 are mounted on pins 94, 96 (FIG. 6) which extend between a wall 90 of the anchor 60 and an outer bar 100 (FIG. 6). The central pulley 94 is mounted on a bar 102 which extends between the pivot pins 104, 106 of the arm members 14, 16.

Figure 5:
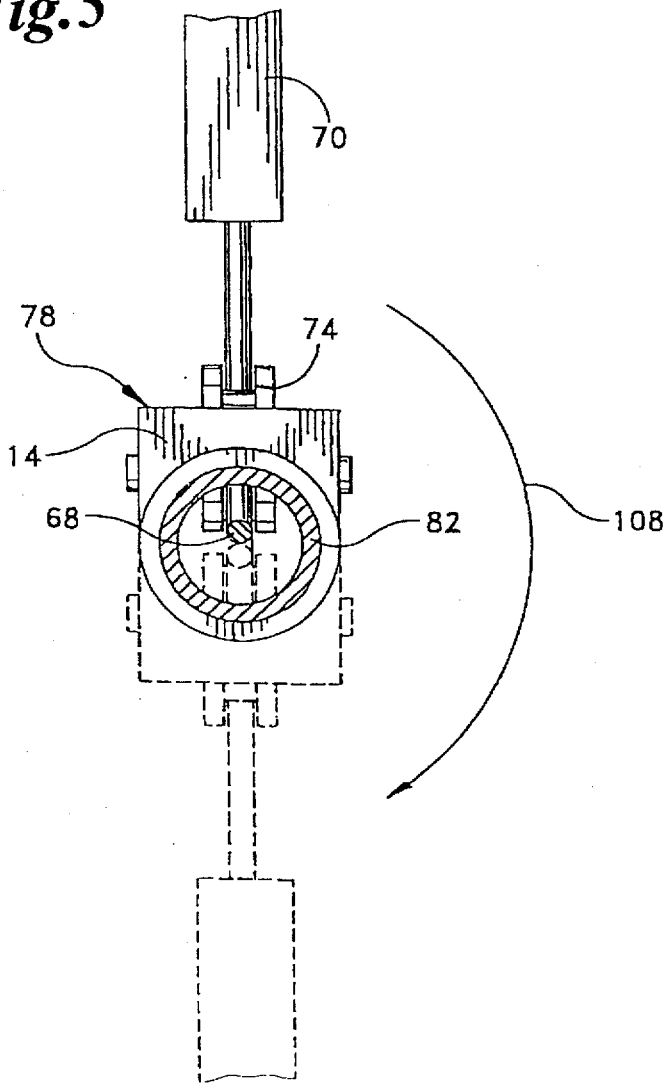
FIG. 5 is a cross-section view of the arm member taken along line 5—5 of FIG. 3.

Referring to FIG. 5, it is pointed out that the end portions 78, 80 of the arm members 14, 16 are rotatable (see arrow 108) with respect to the center portions 82, 84 whereby the pulleys 74, 76 are allowed to rotate and correctly orient themselves with respect to the direction in which the pull line 68 is being pulled. This feature also helps reduce lateral movement of the pull line 68 with respect to the pulleys 74, 76.

Referring to FIGS. 10–17, a preferred embodiment of the wrist joints 200 of the present invention is depicted. The wrist joints 200 provide for the limited rotation of the end portions 78, 80. The two wrist joints 200 are substantially identical so only one will be described. Referring then to FIGS. 10–13, the wrist joint comprises an end portion 80 operably coupled to the center portion 84 of an arm member (not shown in FIGS. 10–17). The end portion provides a hollow pulley housing for receiving a pulley 76 and the pull line 68. The pulley 76 is conventionally mounted on an axle pin 204. The pulley housing 202 includes an opening for receiving the pulley 76. The opening has peripheral edges 203, at least a portion of which, indicated at 205, are selectively angled to position the handles 70, 72 in a selected orientation with respect to the housing 202 and the user. The pulley housing 202 includes an integral cylindrical cup 206. A sleeve 208 is at the proximal end of the end portion 80. The sleeve 208 has the same diameter as the cup 206 and is spaced therefrom but integrally connected thereto by a bridge 210 and pass 212. A support flange and web 214 extends from the pulley housing 202 to the proximal extremity of the sleeve 208. Together, the bridge 210 and pass 212 define an opening for receiving a stop collar 216. The stop collar 216 is an open-ended cylinder and carries two stop ribs, both indicated at 218 (see also FIGS. 14 and 15), on its outer surface. A hole 221 is provided for receiving a rivet 222 or the like for connected the collar 216 to the central portion 84 of an arm.

Figure 16:
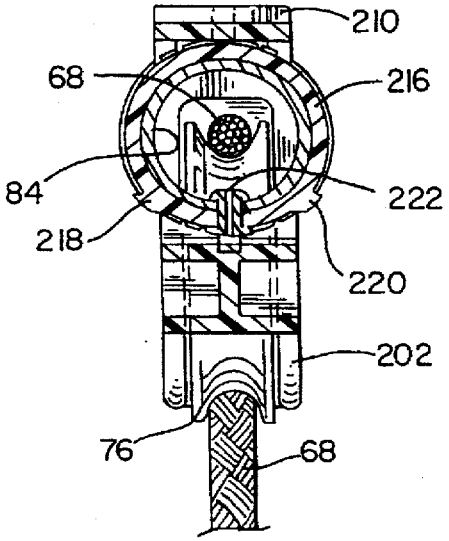
FIG. 16 is a sectional view taken along line 16—16 of FIG. 11.
Figure 17:
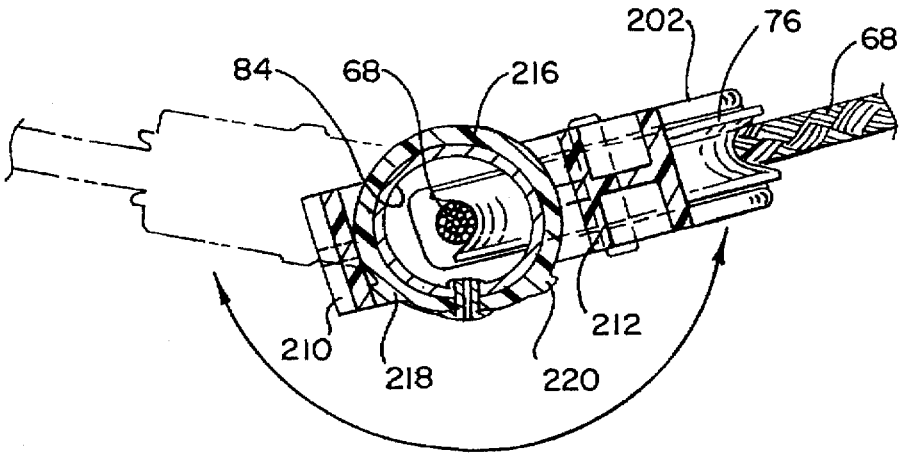
FIG. 17 is a sectional view taken along line 17—17 of FIG. 10.

To assemble the wrist joint 200, the collar 216 is placed in the opening between the sleeve 208 and cup 206, and generally aligned with the central cores thereof. The end pull line 68 is passed through the aligned sleeve 208, collar 216 and cup 206; over the pulley 76, previously mounted in the pulley housing 202, and connected to the handle 72. Then the central portion 84 of the arm is inserted in the sleeve 208, through the collar 216 and into the cup 206. The arm is secured in place relative to the end portion by connecting it to the collar 216 by using the rivet 222. FIG. 16 depicts the assembled joint 200. It should be appreciated that the central portion of the arm, coupled to the collar 216, is free to rotate within the sleeve 208 and cup 206, being held longitudinally by the abutting of the ends of the collar 216 against the ends of the sleeve 208 and cup 206. As depicted in FIG. 17, the range of rotational motion is confined to the freedom of rotational movement of the collar 216 between the two stop ribs 218, 220, i.e., when one of the ribs 218, 220 contacts the bridge 210, no further rotation in that direction is possible. Thus the handles are free to rotate, depending on the exercise being performed, within a range of motion. The degree or range of motion possible is governed by the location of the stop ribs 218, 220, which can be varied. Also, although an assembly procedure is described above, the exact sequence thereof may be varied. An opening is depicted for receiving the collar 216, but it is possible that an expanded region of the sleeve 208 may receive the collar 216, as long as the collar 216 and the central portion 84 of the arm member can be coupled by the rivet 222 or like means such as a set screw, screw or snap ring.

As a representative use of the arm members 14, 16 during an exemplary pectoral muscle exercise, an operator may sit on seat portion 26 with his/her back against the back rest portion 24. With the arm members 14, 16 positioned at their second, middle position as illustrated in solid lines in FIG. 2, the operator would then grasp the handles 70, 72, turn them and press the handle 70, 72 forwardly within a generally horizontal plane, thereby simulating a conventional bench press type exercise.

Figure 8:
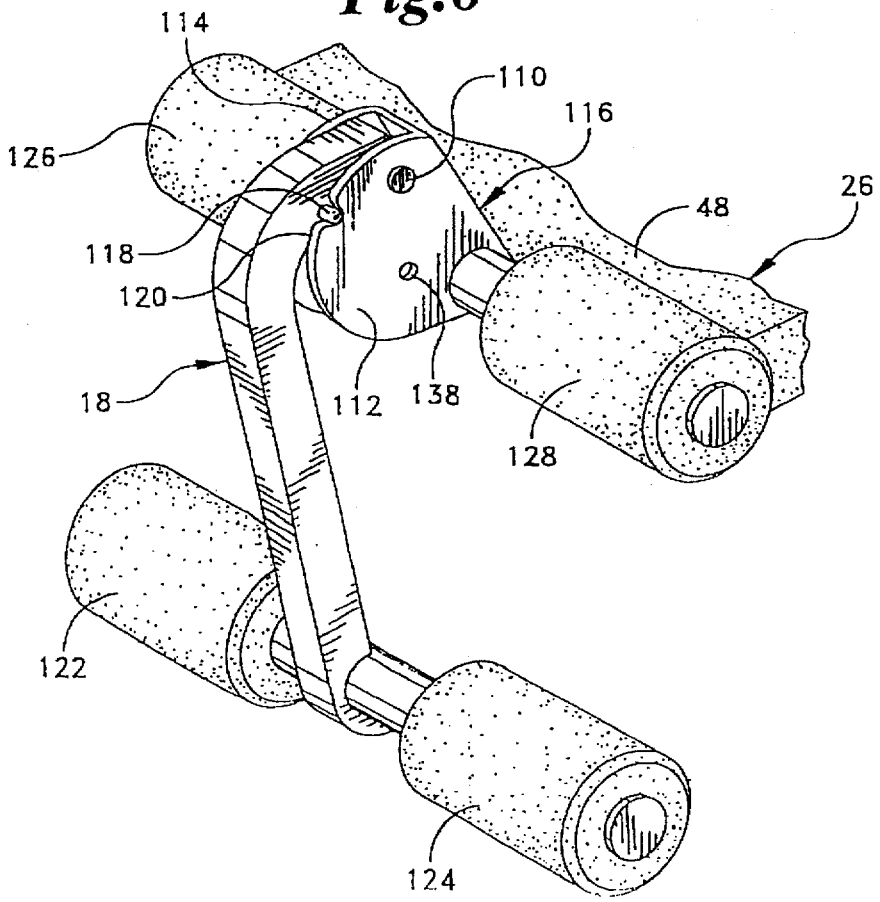
FIG. 8 is an enlarged, fragmentary perspective view of the leg member of the exercise apparatus.
Figure 7:
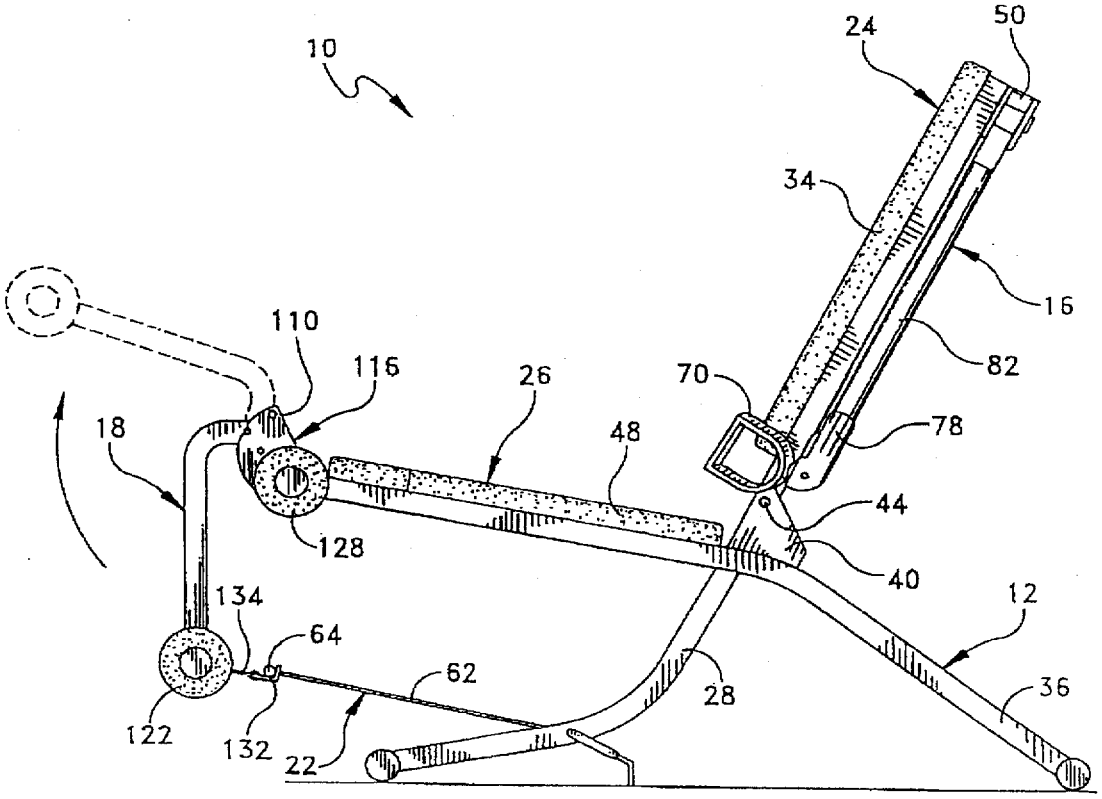
FIG. 7 is a side view of the exercise apparatus showing extension of the leg member during use thereof.

The leg member 18 is pivotally mounted at a first end thereof to the forward end of the seat portion 26, and is pivotally movable between a rest position (solid lines (FIG. 7)) wherein the leg member 18 is generally perpendicular to the seat portion 26, and an extended position (broken lines FIG. 7) wherein the leg member 18 is generally parallel to the seat portion 26. More specifically, the pivotal mounting of the leg member 18 is accomplished by a pin 110 on the first end of the leg member 18 which is received through aligned apertures in facing plates 112, 114 of a channel member generally indicated at 116 (FIG. 8). The leg member 18 is held in the rest position by a spring pin 118 which engages with a notice 120 formed in plate 112. The second end of the leg member 18 is provided with opposing padded foot pegs 122, 124 for receiving the ankles of the operator. A second pair of padded pegs 126, 128 is provided adjacent the seat portion 26 for receiving the knees of the operator.

The second resistance assembly 22 comprises a second fixed anchor 130 mounted to the frame 12, a movable anchor 132 coupled to the second end of the leg member 18 by an inelastic line 134, and a plurality of extendable resistance members 62 received between the fixed anchor 130 and the movable anchor 132. It is pointed out that fixed anchors 58 and 130, respectively, are actually formed as a single anchor assembly affixed to the frame 12. The movable anchor 132 is movable with the leg member 18 during movement thereof between the rest position and the extended position whereby the resistance members 62 provide resistance to such movement. As described previously, the resistance members 162 comprise elastomeric cords having enlarged bulbs 64 at the ends thereof which are slidably received in engagement with edge slots 136 formed in the respective anchors 130, 132. As described in connection with use of the arm members 14, 16, one or more of the cords 62 may be utilized for providing different levels of resistance. The leg member 18 is further movable from the rest position to a storage position (FIG. 9) by depressing the spring-loaded pin 118 and rotating the leg member 18 to a position beneath the seat portion 26 wherein the leg member 18 is generally parallel to the padded panel 48. The leg member 18 is maintained in the storage position by the spring-loaded pin 118 which extends through corresponding aperture 138 formed in plate 112 (FIG. 8).

It can therefore be seen that the instant invention provides an effective strength training exercise apparatus 10 which provides unparalleled portability, storage, and total body exercise versatility which have not been found before in the prior art. The unique frame assembly 12 quickly and easily folds for storage and similarly unfolds use. The unique elastomeric cords 62, easily attach and detach from their anchors for quick changes of resistance during use, while providing effective and efficient resistance during use, while providing effective and efficient resistance to exercise movement. Use of different numbers of elastomeric cords 62 permits differing resistance levels for all exercises. The pair arm members 14, 16 securable in a plurality of different positions, along with the extendable leg member 18 permit a multitude of different exercises for strengthening all seven of the major muscle groups including legs, chest, back, shoulders, biceps, triceps and abdominal. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. A wrist joint member adapted for use between a handle and an arm, the wrist joint member operably and rotatably adapted to couple to the arm and including a sleeve and a pulley housing for receiving a pulley, said sleeve having an open end and a cup end adapted for receiving an end of the arm and an opening located between the open end and the cup end for receiving a stop collar adapted for fixed connection to the arm.

2. The wrist joint member according to claim 1, wherein the sleeve includes a flange and web adjacent to the opening.

3. The wrist joint member according to claim 1, wherein the stop collar comprises an open-ended cylinder with an outside surface, and carries at least one stop rib on the outside surface.

4. A wrist joint member adapted for use between a handle and an arm, the wrist joint member comprising an end portion including a generally hollow portion for receiving a pulley, said end portion adapted to operably couple to the arm and having a sleeve connected to the hollow portion, said sleeve having an open end spaced from the hollow portion and a closed cup end adjacent to the hollow portion, said open end and cup end adapted for receiving an end of the arm and separated by an opening for receiving a stop collar adapted for fixed connection to the arm whereby the arm is captured in the sleeve and the end portion is rotatable with respect the arm.

* * * * *